United States Patent [19]

Hirose

[11] 4,162,890

[45] Jul. 31, 1979

[54] COMBUSTION APPARATUS

[75] Inventor: Yasuo Hirose, Yokohama, Japan

[73] Assignee: Bloom Engineering Company, Inc., Pittsburgh, Pa.

[21] Appl. No.: 792,978

[22] Filed: May 2, 1977

[51] Int. Cl.[2] ..... F23D 15/00

[52] U.S. Cl. ..... 431/351; 431/115; 431/353

[58] Field of Search ..... 431/181, 187, 188, 115, 431/351; 239/424, 424.5

[56] References Cited

U.S. PATENT DOCUMENTS

| | | | |
|---|---|---|---|
| 2,458,543 | 1/1949 | Urquhart | 431/188 |
| 2,815,069 | 12/1957 | Garraway | 431/188 |
| 3,132,683 | 5/1964 | Meyer | 431/188 |
| 3,711,243 | 1/1973 | Zink et al. | 431/181 |
| 3,868,211 | 2/1975 | La Haye et al. | 431/351 |
| 3,876,362 | 4/1975 | Hirose | 431/252 |
| 4,035,137 | 7/1977 | Arand | 431/115 |

FOREIGN PATENT DOCUMENTS

| | | | |
|---|---|---|---|
| 194514 | 4/1957 | Austria | 431/187 |
| 2324493 | 12/1973 | Fed. Rep. of Germany | 431/352 |

*Primary Examiner*—Carroll B. Dority, Jr.

*Attorney, Agent, or Firm*—Webb, Burden, Robinson & Webb

[57] ABSTRACT

Fuel is injected into a combustion chamber by a central burner. Combustion air is fed through an air supply passage provided in a plurality of air ejection holes on an annular plate surrounding the front end of said air supply passage.

6 Claims, 12 Drawing Figures

COMBUSTION APPARATUS

BACKGROUND OF THE INVENTION

My invention is directed to a combustion apparatus and, more particularly, to a combustion apparatus used to heat furnaces and the like by burning gas or oil in a manner that results in a reduced amount of oxides of nitrogen in the products of combustion.

Industry's increased awareness of the harmful effects of oxides of nitrogen (hereinafter "NOx") and the stringent requirements set by government environmental agencies regarding the amount of this pollutant that can be emitted by a furnace into the atmosphere have created a demand for furnace combustion devices that burn fuel so that the exhaust gases contain low amounts of NOx. To achieve this reduction, it is desirable to burn a rich fuel mixture in a low temperature flame while recycling the unburned mixture.

As will be described below in greater detail, my combustion method claimed in U.S. Pat. Nos. 3,876,362 and 3,954,382 utilizes a rich fuel mixture and a low temperature flame to reduce the levels of NOx in the products of combustion. The method claimed in these patents comprises injecting fuel at a high velocity through a cylindrical burner tile structure to a combustion chamber and deflecting the stream against the inside wall of the structure, thereby causing a counterflow of high temperature combustion gases from the combustion chamber back through the tile structure to mix with the injected fuel. Air in a quantity less than theoretical air is supplied through an annular passage to the mixture as it enters the combustion chamber thereby promoting endothermic gasification of the fuel before it enters the combustion chamber which results in the fuel rapidly and completely burning at a relatively low temperature.

In order to promote the mixing of the combustion air with the fuel mixture, vanes are placed in the passage supplying the combustion air to the combustion chamber so that the air enters the combustion chamber in a spinning stream. However, the apparatus of these patents has the disadvantage of causing a rapid burning of the fuel mixture which restricts flame size and tends to give it a somewhat uneven temperature.

SUMMARY OF THE INVENTION

My combustion apparatus reduces the rate of NOx production by as much as half as compared to the prior art devices previously described. This reduction can occur with the burning of either city gas or C heavy oil. This marked reduction and the rate of NOx produced by my apparatus occurs because my apparatus delays the mixing of the fuel mixture with the combustion air and thus slows the burning of the fuel. An additional advantage of my apparatus is that it creates a larger diameter, longer flame than that of prior art apparatus so that a larger area of the furnace is placed in direct contact with the flame. Another advantage of my apparatus is that the larger flame created is even more uniform in temperature and thus can evenly heat the adjoining furnace.

My combustion apparatus comprises a combustion chamber; a cylindrical tile structure attached to the combustion chamber at an end; a cover plate which is attached to the tile structure at an opposite end; a means forming an air supply passage adjacent the tile structure; an inlet from the air supply passage through the tile structure; and a baffle plate positioned between the air supply passage and the combustion chamber having at least one restricted opening connecting the air supply passage with the combustion chamber. The restricted opening of the baffle plate serves to increase the velocity of the combustion air with respect to the fuel mixture while not increasing the proportion of fuel to air. Thus, mixing is delayed, the burning rate is reduced, and the counterflow of unburned gases is increased, promoting endothermic gasification of the fuel mixture and decreasing the formation of NOx.

DETAILED DESCRIPTION OF THE INVENTION

The combustion method of the prior invention will be described herein below with reference to FIG. 1.

Figure 1:
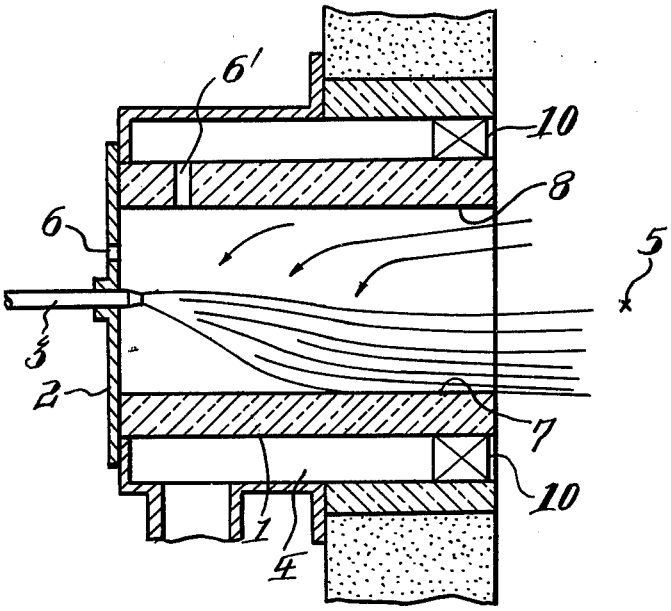
Fig. 1 PRIOR ART
FIG. 1 is a side sectional elevation showing a combustion apparatus for practicing the combustion method developed precedently by the present inventor.

In FIG. 1, a cylindrical burner tile 1 is closed partly or fully at the front end by a cover plate 2. A gas burner or an oil burner 3, injecting fuel and imparting large momentum to the fuel jet, is secured to the plate 2, so that fuel or a mixture of fuel and an atomizing medium ejected from said burner flows axially through the cylindrical burner tile 1 at a high velocity. Primary air supplied to the cylindrical burner tile is limited to a small amount not exceeding the explosion limit of fuel. Secondary air, occupying the major part of the combustion air, passes through a secondary air supply passage 4 having annular section, provided outside said cylindrical burner tile structure, and is supplied directly to a combustion chamber 5.

The front end of the annular combustion air passage surrounding the cylindrical burner tile structure is closed. When a fuel jet having large momentum shoots through the cylindrical burner, high temperature combustion gas counterflows into the cylindrical burner from the combustion chamber. High temperature combustion gas which has counterflowed in said cylindrical burner tile structure is sucked up quickly in the fuel jet and is consumed. Hence, high temperature combustion gas continuously counterflows.

High temperature combustion gas which has been sucked up in the fuel jet is uniformly diffused, thereby promoting a quick endothermic gasification reaction with the fuel. Since the partially burnt gas produced by this endothermic gasification reaction contains reduced $H_2$ or CO in large quantities, the gas easily can be ignited and burnt when it arrives in the combustion chamber 5. There the gas is supplied with secondary air and it rapidly flames. The flame thus produced has an ideal temperature distribution without forming any partial high temperature portion. As a consequence, NOx generating rate can be remarkably reduced as compared with conventional combustion.

As a result of tests, it has been found that the amount of high temperature combustion gas counterflowing into the cylindrical burner tile structure 1 can be increased to about 60% of the amount of air for theoretical combustion, and further the gas can be caused to counterflow at all times in a substantially constant amount. This is possible by Coanda Effect caused generally by the high velocity stream within the cylindrical burner tile 1. To facilitate occurence of Coanda Effect, the outer annular front end of the cylindrical burner structure 1 is closed by the plate 2, and air stream inlets 6 and 6' are provided in said plate and in said cylindrical burner tile structure. A fuel jet having large momentum is passed through the cylindrical burner tile 1. The fuel jet is constantly deflected towards the inner side wall 7 opposite to said air inlet 6' and advances along said inner side wall 7, while being interfered with by said inner side wall 7. When the Coanda Effect is thus stabilized on the specific side wall 7, counterflow of high temperature combustion gas is facilitated along the opposite side wall 8. Furthermore, the fuel jet interference with side wall 7 promotes vigorous diffusion and endothermic gasification reaction, and the amount of high temperature combustion gas becomes large and is maintained at a constant value at all times.

As a result of tests, it was discovered that the endothermic gasification reaction occurred within the cylindrical burner tile 1, and the resulting mixture was supplied to the combustion chamber 5, whereby complete combustion of fuel could be performed at an excess air ratio less than the conventional general excess air ratio, for instance, at an air ratio of $\lambda=1.1$. Since the thus obtained flame did not form local high temperature portions, it was found that NOx generating rate was reduced remarkably by half lower than that of the conventional method, and the soot generating rate was also be reduced.

As a result of repeating various tests for improvements in the basic low NOx generating combustion apparatus, it has been found that the NOx generating rate can be reduced even further.

The first improvement resides in that the sectional area of said air supply passage is narrowed at the furnace end of said air supply passage 4 provided outside the cylindrical burner tile structure 1 thereby accelerating the injection velocity of air from 10 m/sec to between 30 and 100 m/sec m as compared with that of the conventional apparatus, whereby the occurrence of the spinning stream at the outlet of said cylindrical burner tile structure is promoted and counterflow of combustion gas into said burner tile structure is activated. As a result, NOx generating rate is reduced by about half as compared with the basic low NOx combustion apparatus.

Figure 3:
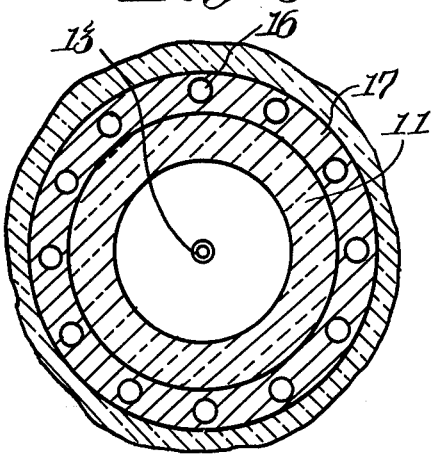
FIGS. 3, 4 and 5 are sections of the combustion apparatus according to the present invention taken on line A—A in FIG. 2, as viewed from the furnace side, the outlet of the combustion air supply passage 14 being remolded as shown in the figure.
Figure 4:
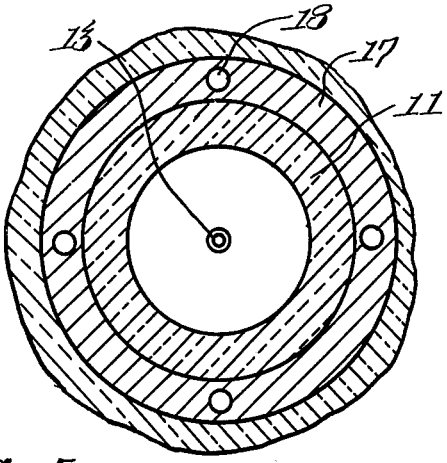
Figure 5:
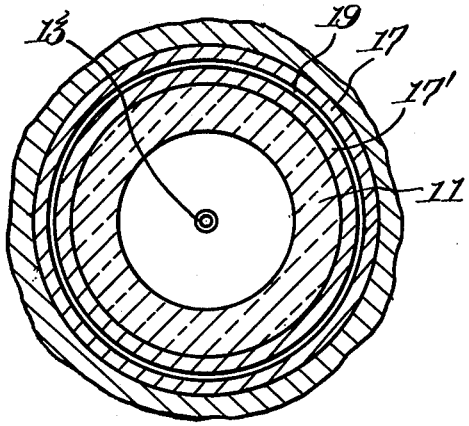

The structures shown in FIGS. 3, 4 and 5 increase air velocity from the conventional 10 m/sec or less to from 30 m/sec to 100 m/sec, whereby the spinning stream of combustion gas is mixed vigorously at the outlet of the burner tile structure, and this spinning stream is reintroduced considerably vigorously into the burner tile structure. Accordingly, combustion gas can be caused to counterflow into the burner tile structure more easily, and endothermic gasification reaction is accurately carried out, and NOx generating rate can be further remarkably reduced.

Figure 2:
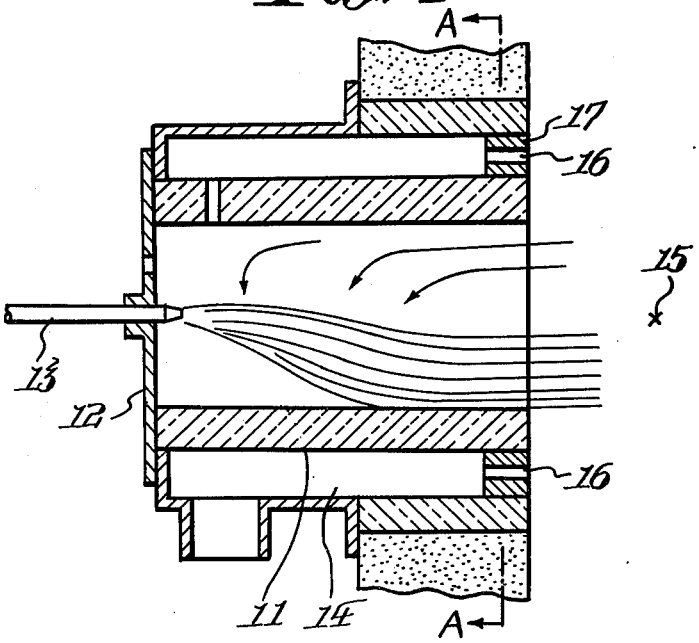
FIG. 2 is a side sectional elevation of the combustion apparatus of the present invention.

FIG. 2 shows a combustion apparatus in which the furnace end of the air supply passage 14 is fitted by an annular baffle plate 17. Said baffle plate 17 has holes 16 formed therein.

FIG. 3 shows a baffle plate 17 having twelve holes 16. To maintain the proper proportions of combustion air and fuel mixture during the operation of this embodiment of the invention, the velocity of the combustion air should be approximately 30 m/sec.

FIG. 4 shows another combustion apparatus in which the forward end of the air supply passage 14 is fitted by the baffle plate 17 which has four holes 18 formed therein. To maintain proper proportions of air and fuel, the velocity of the combustion air for this embodiment should be approximately 90 m/sec.

FIG. 5 shows still another combustion apparatus in which cylindrical sleeves 17 and 17' are secured to the forward end of the air supply passage 14 (as shown in FIG. 2). Air is injected through a space 19 having a width about 1/5 that of the conventional apparatus and formed between these sleeves. The velocity of air being selected to be about 100 m/sec.

Figure 6:
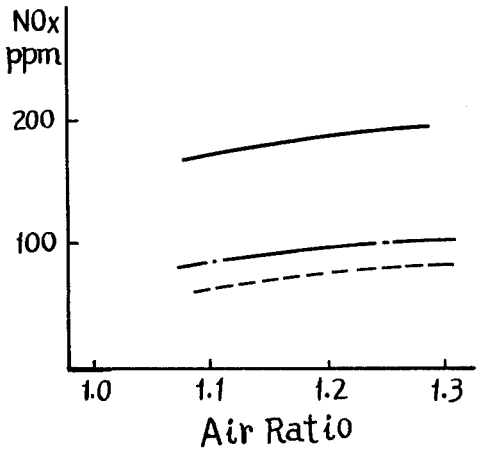
FIGS. 6 and 7 are graphical representations respectively showing NOx generating rates in the structures of outlets of combustion air supply pipes shown in FIGS. 3, 4 and 5, in the case of using city gas as fuel and in the case of using C heavy oil as fuel.
Figure 7:
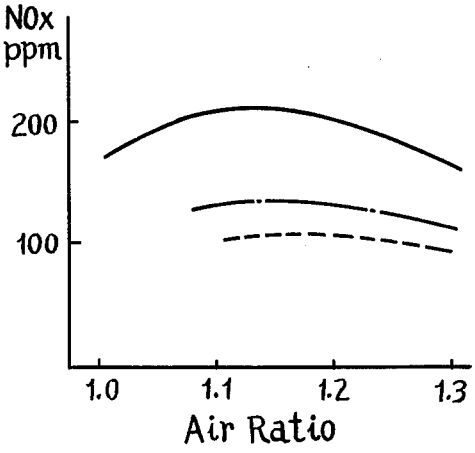
Figure 8:
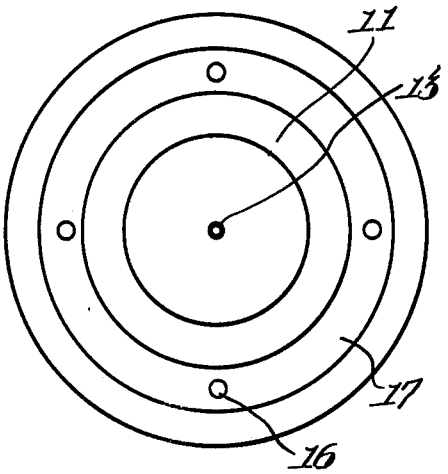
FIGS. 8A, 8B, 8C and 8D are forward elevations respectively showing the combustion apparatuses according to the present invention with four, three and two air ejection holes and one ejection hole, respectively, as viewed from the combustion chamber side.
Figure 8:
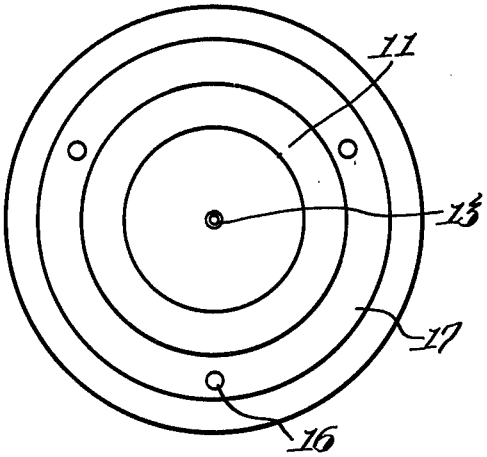
Figure 8:
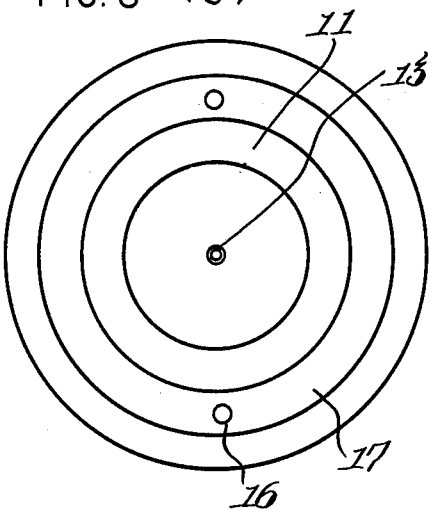
Figure 8:
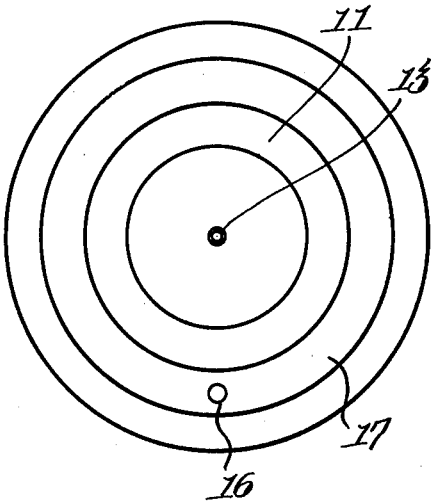

FIG. 6 is a graphical representation showing the case of using city gas as fuel. FIG. 7 is a graphical representation showing the case where C heavy oil is atomized by steam and injected. In both graphical representations there are shown the results of the tests by representing the values of the combustion apparatus shown in FIG. 3 in solid lines, the values of the combustion apparatus shown in FIG. 4 in chain lines with consecutive dots, and the values of the combustion apparatus shown in FIG. 5 in dotted lines.

As shown in the graphical representations of FIGS. 6 and 7, even in the case of using heavy oil as well as city gas as fuel, according to the combustion method developed by the present invention, when air velocity is increased, that is, when air in a required amount is supplied through a slit formed to be as narrow as possible, NOx tends to decrease and the degree of reduction is considerably large.

The preferred embodiment of the invention is depicted in FIGS. 8A, 8B, 8C, and 8D. In the baffle plate 17 on the furnace end of said secondary air supply passage, as shown in FIGS. 8A, 8B, 8C and 8D, air ejection holes 16 are formed in numbers of four, three, two and one, respectively.

In the combustion apparatus relating to the basic invention (FIG. 1), supply of combustion air from the air supply passage 4 is performed in such a manner that the air supply passage 4 is provided at its forward end with a rotary vane 10 rotating to discharge whirling air surrounding annularly the entire circumference of the partially burnt gas flowing from the cylindrical burner tile 1. The circumference of the partially burnt gas is substantially surrounded by a large number of air jets at air velocities of 10 m or less per second. The partially burnt gas is rapidly brought into contact and mixed with air, and burns.

However, the combustion apparatus according to the preferred embodiment of the present invention, only a very small number of air injection holes are formed. Partially burnt gas near said air jet comes into contact with air and rapidly burns, but the partially burnt gas remote from the air jet has no chance to come into contact with air and mix therewith. Contact mixing between gas and air is delayed, and combustion is thus delayed. Hence, the flame obtained has a large diameter, and its length is elongated, thus becoming larger than the flame of the basic apparatus. Furthermore, this flame does not partly form particularly high temperature portions (so-called "hot spots") and burns more slowly than that obtained by the combustion apparatus according to the basic invention, as a result of which NOx generating rate is further reduced as compared with the low NOx combustion apparatus according to the basic invention.

Figure 9:
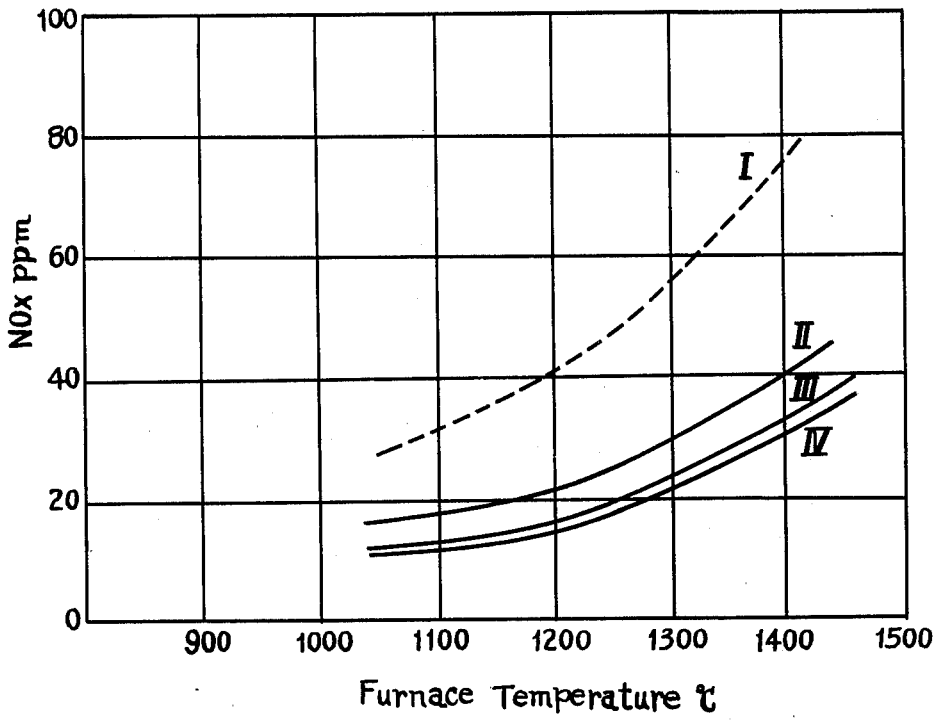
FIG. 9 is a graphical representation of NOx generating rate (represented by solid line) in the combustion apparatus according to the present invention, in comparision thereof with NOx generating rate (represented by dotted line) in the low NOx combustion apparatus according to the basic invention.

FIG. 9 is a graphical representation showing the reduction of NOx generating rate by the combustion apparatus according to the preferred embodiment of the present invention in comparison with that by the low NOx generating apparatus according to the basic invention. In FIG. 9, the axis of coordinates represents $O_2$ 11% converted NOx PPm and the axis of abscissae represents the furnace temperature in degrees centigrade. NOx generating rates of the combustion apparatus according to the basic invention in respective furnace temperatures are represented by dotted line I, and Nox generating rates of the combustion apparatus according to the preferred embodiment of the present invention in the case of providing four air injection holes by solid line II, in the case of providing three air injection holes by solid line III, and in the case of providing two air injection holes by solid line IV.

Tests according to the above described graph were performed using city gas as fuel. The amount of fuel used was 1,800,000 KCal/hr., air ratio $\lambda=1.1$. The temperature of supplied air was 400° C., and the motive air of the burner was 8%. NOx generating rate in the combustion apparatus according to the present invention is reduced by about half as compared with NOx generating rate in the combustion apparatus according to the basic invention.

Although the above description was made with respect to the data of gaseous fuel, NOx generating rate is reduced similarly with respect to the case of using heavy oil fuel.

Furthermore, it is not always necessary to arrange the air ejection holes respectively at symmetric positions with respect to the center. The holes can be arranged deflectively toward the side wall which must be preponderantly heated in the furnace, with the heating efficiency being rather improved.

Although it has been described above that the present invention is applied to the combustion apparatus according to the basic invention, the present invention is not limited to the combustion apparatus according to the basic invention it can be applied for various combustion apparatuses each have a burner at the central part and combustion air is supplied from the circumference of said burner. Even in this case, the effect of remarkable reduction of NOx generating rate can be achieved.

While the invention has been described in part with reference to specific embodiments, it will be obvious that modifications and variations of the invention may be made without departing from the scope of the invention, which is defined in the following claims.

I claim:

1. A combustion apparatus comprising:

A. a combustion chamber;

B. a tile structure having inner and outer side walls, said inner side wall defining an interior cavity of said tile structure, and an end communicating with said combustion chamber;

C. a disk-shaped cover plate attached to an opposite end of said tile structure;

D. an annular air passage adjacent said outer side wall of said tile structure and connected to a source of air above atmospheric pressure;

E. a burner means extending through said cover plate and positioned so that it directs a stream of fuel at a velocity sufficient to create a Coanda effect axially through said interior cavity to said combustion chamber whereby combustion gases are drawn back through said interior cavity to mix with said stream of fuel;

F. an air stream inlet on one side only and in said tile structure connecting said air passage to said interior cavity and positioned so that combustion air in an amount less than that necessary to burn said fuel stoichiometrically enters said interior cavity in a direction normal to said stream of fuel and stabilizes the position of said stream of fuel along a portion of said inner side wall opposite said air stream inlet; and G. a baffle plate placed between said annular air supply passage and said combustion chamber, said baffle plate having one or more air jets passing therethrough connecting said air passage to said combustion chamber, at least one of said jets being located on substantially the same side of said tile as said air stream inlet, whereby combustion air is supplied to said combustion chamber at a velocity of not less than about 30 meters per second.

2. The combustion apparatus of claim 1 wherein said one or more air jets comprises not more than four air ejection holes each of a size such that the velocity of said combustion air entering said combustion chamber through said holes is not less than about 90 meters per second.

3. The combustion apparatus of claim 2 wherein said one or more air jets supply air to the combustion chamber in an amount exceeding that needed for theoretical combustion by about 10 percent.

4. The combustion apparatus of claim 1 wherein said cover plate has a second air stream inlet which connects said interior cavity to an air supply.

5. The combustion chamber of claim 1 wherein said tile structure is cylindrical in shape.

6. A combustion apparatus comprising:

A. a combustion chamber;

B. a tile structure having inner and outer side walls, said inner side wall defining an interior cavity of said tile structure, and an end communicating with said combustion chamber;

C. a disk-shaped cover plate attached to an opposite end to said tile structure;

D. an annular air supply passage adjacent said outer side wall of said tile structure and connected to a source of air above atmospheric pressure;

E. a burner means extending through said cover plate and positioned so that it directs a stream of fuel at a velocity sufficient to create a Coanda effect axially through said interior cavity to said combustion chamber whereby combustion gases are drawn back through said interior cavity to mix with said stream of fuel;

F. an air stream inlet on one side only and in said tile structure connecting said air passage to said interior cavity and positioned so that combustion air in an amount less than that necessary to burn said fuel stoichiometrically enters said interior cavity in a direction normal to said stream of fuel and stabilizes the position of said stream of fuel along a portion of said inner side wall opposite said air stream inlet; and G. a baffle formed of two concentric cylindircal sleeves defining an annular restricted air jet slit therebetween connecting said air passage to said combustion chamber whereby combustion air is supplied to said combustion chamber through said slit at a velocity of not less than about 100 meters per second.

* * * * *